US010422193B2

(12) United States Patent
Vaughan

(10) Patent No.: US 10,422,193 B2
(45) Date of Patent: Sep. 24, 2019

(54) COILED TUBING INJECTOR DRIVELINE

(71) Applicant: PREMIER COIL SOLUTIONS, INC., Waller, TX (US)

(72) Inventor: Phillip D. Vaughan, Richmond, TX (US)

(73) Assignee: Premier Coil Solutions, Inc., Waller, TX (US)

( * ) Notice: Subject to any disclaimer, the term of this patent is extended or adjusted under 35 U.S.C. 154(b) by 178 days.

(21) Appl. No.: 15/707,106

(22) Filed: Sep. 18, 2017

(65) Prior Publication Data

US 2018/0080293 A1 Mar. 22, 2018

Related U.S. Application Data

(60) Provisional application No. 62/396,461, filed on Sep. 19, 2016.

(51) Int. Cl.
*E21B 19/22* (2006.01)

(52) U.S. Cl.
CPC ..... *E21B 19/22* (2013.01)

(58) Field of Classification Search
CPC ..... E21B 19/22
See application file for complete search history.

(56) References Cited

U.S. PATENT DOCUMENTS 5,234,053 A * 8/1993 Connell ..... E21B 19/22 166/250.01
7,467,659 B2 * 12/2008 Nielsen ..... E21B 19/22 166/77.2
8,544,536 B2 * 10/2013 McCulloch ..... E21B 19/22 166/384
2004/0159427 A1 8/2004 Austbo et al.
2011/0075960 A1 * 3/2011 White ..... F16C 19/30 384/606
2016/0002987 A1 1/2016 McCulloch et al.
2016/0138347 A1 * 5/2016 Bjornenak ..... E21B 19/22 166/66

FOREIGN PATENT DOCUMENTS

CN 103114819 B 12/2008
CN 201714322 U 1/2011
CN 202832309 U 3/2013

OTHER PUBLICATIONS

International Search Report & Written Opinion (PCT/2017/052013), dated Nov. 20, 2018.

* cited by examiner

*Primary Examiner* — Caroline N Butcher
(74) *Attorney, Agent, or Firm* — Lloyd L. Davis; Hunton Andrews Kurth LLP

(57) ABSTRACT

A coiled tubing injector head unit includes a first bearing carrier and a second bearing carrier attached to a frame of the injector head unit that support an input drive shaft extending between the first and second bearing carriers, a sprocket shaft coupled to the input drive shaft that supports a pair of continuous parallel drive chains that revolve in a common plane and have opposed, elongated parallel runs spaced apart to form a path for engaging tubing passing there through, and a hydraulic motor attached to the frame opposite the first bearing carrier, and a gearbox attached to the frame opposite the second bearing carrier, wherein the input drive shaft is operatively connected to and extends between, but is not supported by, the hydraulic motor and the gearbox.

5 Claims, 1 Drawing Sheet

COILED TUBING INJECTOR DRIVELINE

CROSS-REFERENCE TO RELATED APPLICATIONS

This application claims priority under 35 U.S.C. § 119(e) to U.S. Provisional Application No. 62/396,461 filed Sep. 19, 2016, which is incorporated herein by reference in its entirety.

FIELD

Embodiments disclosed herein relate to coiled tubing units. More particularly, embodiments disclosed herein relate to an improved coiled tubing injector head driveline.

BACKGROUND

In the oil and gas industries, coiled tubing refers to a very long metal pipe supplied spooled on a large reel. It is used for interventions in oil and gas wells and sometimes as production tubing in depleted gas wells. A relatively modern drilling technique involves using coiled tubing instead of conventional drill pipe.

FIG. 1 illustrates generally a coiled tubing setup. The coiled tubing is fed from a reel into the injector which effectively powers the tubing into the wellhead. The end of the coiled tubing string can be outfitted with numerous downhole tools including drill bits and other related drilling equipment. The "gooseneck" or tubing guide is the angled piece on the injector which guides the tubing and allows a bending of the coil string to allow it to go through the injector. It is what guides the tubing from the reel and directs the tubing from an upwards angle and turns it into a vertical down position into the injector and through a blow-out preventer (BOP) stack into the wellhead. The injector and tubing guide are connected together and are suspended by a crane or similar lifting methods for operations.

The main engine of a coiled tubing unit is the injector head, which contains the mechanism to push and pull the coiled tubing in and out of the hole. The injector head includes motors powered by hydraulic fluid. The hydraulic motor then turns a shaft positioned horizontally through the top portion of the injector into a gearbox. The gearbox is configured to reduce the output of the motor to provide functional response to a shaft which powers large cog type gears, e.g., sprockets, or any drive style component, which in-turn moves drive chains to be moved along with gripper blocks that move the tubing along its path in or out the well.

Injector breakdowns during operation can have disastrous results, for personnel, equipment, safety, and cost effectivity. The injector is typically suspended high above the well being serviced. Any failure of an injector head motor or gearbox during operation would pose a situation in which the tubing inside the injector would become stuck, and have to be severed to move the injector off of the wellhead to perform service. Prior to cutting the string of tubing, all pumping operations must also cease. The tubing must be severed at a precise angle, the tubing guide removed, and carefully positioned as to not pose danger the crew or equipment. The injector can be forcefully removed by crane, and then it has to set on either the trailer or ground for gearbox replacement. The injector is then repositioned over the string and the tubing guide is re-installed and the tubing is then clamped together above the gripper blocks as to not place a strain on the clamp, and the remaining pipe down in the well is removed. During the breakdown, if it is possible, well circulation needs to continue to allow the tubing to be removed, if the circulation is not maintained, it may result in well bore damage. This entire process, if no issues arise, may typically last 18-30 hours, or more, depending on the skillset and tools available for the crew. This is highly dependent on having a spare gearbox on hand, which is a very expensive and heavy item and is not typically stocked by a crew as a spare part. Gearboxes can weight anywhere from 300 lbs to 1,000 lbs or more depending on the size of the injector, challenging work crews with logistical issues even with the most simple repair.

On prior injector heads the gearbox is mounted on one side of the injector head and connects to a driveline or shaft running horizontally from the hydraulic motor through the chassis connecting to the gearbox. The gearbox, motor, and transfer shaft running between the gearbox and motor are the sole support structure for the chains, gripper blocks and the entire coil tubing string from the reel to the well. Removing the gearbox while the injector is in the normal operating position is not an option because the motor and sprocket shaft are unable to support the mass of the entire unit. Accordingly, prior injector heads cannot be serviced under load, or not under load for this reason. All prior injector head gearboxes have to be removed with the unit disabled from the well and a disassembly of the chain and drive components in order to remove the gearbox. This method is extremely time consuming and poses a risk for equipment and personnel lifting and moving an injector off the well. Another method of teardown is to lay the injector on the side for gearbox removal.

FIG. 1 illustrates a prior coiled tubing injector 200. The prior coiled tubing injector 200 configuration includes a motor 201 and a gearbox 205, and a transfer shaft 202 connecting the gearbox 205 to the motor 201. The gearbox 205 input is connected to the transfer shaft 202 by mating splines. The gearbox 205 output is connected to the sprocket drive shaft 204 by mating splines. The shaft 204 is not mounted to the chassis of the injector 200, and is instead mounted by the splines, within the inner structure of the gearbox 205. If the gearbox is removed while the injector is vertical, the support structure is unable to support the weight of the chain sprockets 203, and the chain 206 will be unable to support the weight of the tubing and fail structurally.

There have been no approaches or solutions to designing or implementing a structure that would allow a gearbox, motor, shaft or any other upper driveline component to be changed out while the injector is in operation, or not operation or any other configuration while the injector is vertical. What is needed then is an improved coiled tubing injector head driveline.

SUMMARY OF THE INVENTION

In one aspect, embodiments disclosed herein relate to a coiled tubing injector head unit comprising a first bearing carrier and a second bearing carrier attached to a frame of the injector head unit that support an input drive shaft extending between the first and second bearing carriers, a sprocket shaft coupled to the input drive shaft that supports a pair of continuous parallel drive chains that revolve in a common plane and have opposed, elongated parallel runs spaced apart to form a path for engaging tubing passing there through, and a hydraulic motor attached to the frame opposite the first bearing carrier, and a gearbox attached to the frame opposite the second bearing carrier, wherein the input drive shaft is operatively connected to and extends between, but is not supported by, the hydraulic motor and the gearbox.

In other aspects, embodiments disclosed herein relate to a coiled tubing injector head unit driveline for operating a pair of continuous parallel drive chains that revolve in a common plane and have opposed, elongated parallel runs spaced apart to form a path for engaging tubing passing there through, the driveline comprising a first bearing carrier and a second bearing carrier attached to a frame of the injector head unit, a hydraulic motor attached to the frame opposite the first bearing carrier, and a gearbox attached to the frame opposite the second bearing carrier, and an input drive shaft that extends between and is supported by the first and second bearing carriers, wherein the input drive shaft is operatively connected to and extends between, but is not supported by, the hydraulic motor and the gearbox.

BRIEF DESCRIPTION OF THE DRAWINGS

The invention is illustrated in the accompanying drawings wherein.

DETAILED DESCRIPTION

A coiled tubing injector head having an improved driveline is disclosed.

Figure 1:
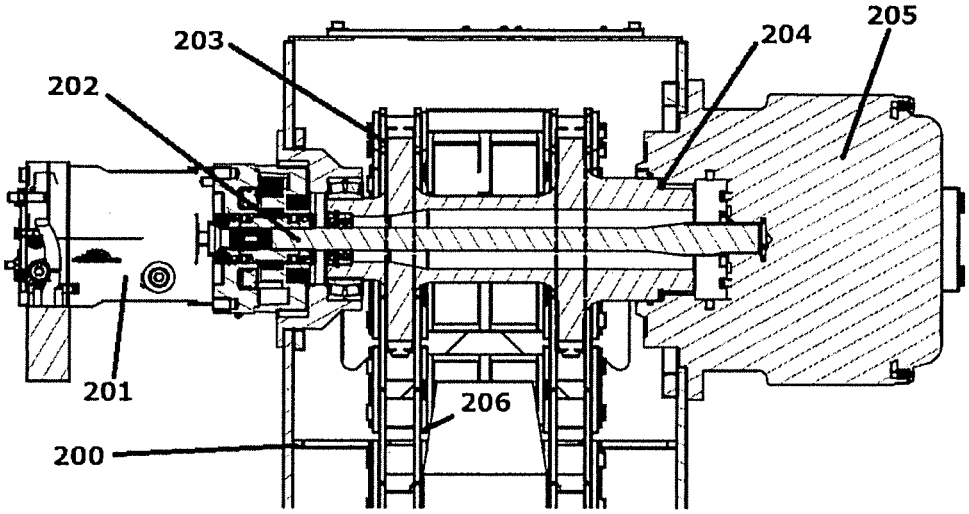
FIGURE 1 PRIOR ART
FIG. 1 illustrates a section view of a prior coiled tubing injector head.
Figure 2:
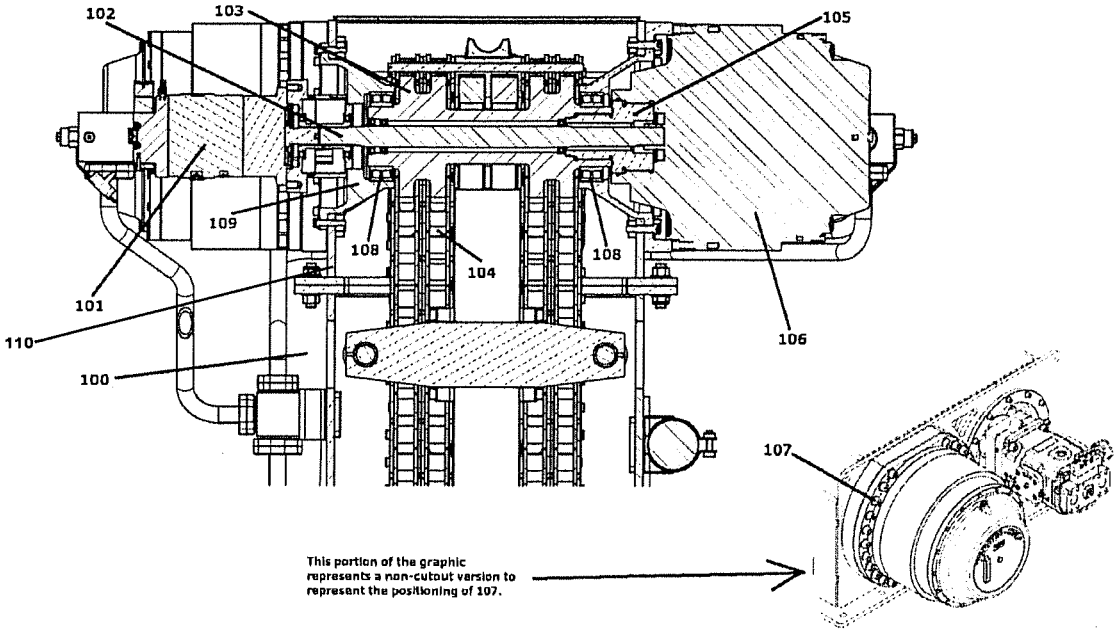
FIG. 2 illustrates a section view of an embodiment of a coiled tubing injector head having an improved driveline.

FIG. 2 illustrates a section view of a coiled tubing injector head 100 having an improved driveline. The injector head 100 includes opposing bearing carriers 109 that are mounted and attached to a frame 110 of the injector head 100. The bearing carriers 109 may be generally conical or any shape. Spherical roller bearings 108 are disposed within the bearing carriers 109. A hydraulic motor 101 is attached to the frame 110 of the injector head 100 opposite a first bearing carrier 109 on a first side, e.g., the motor side, and a gearbox 106 is attached to the frame 110 of the injector head 100 opposite a second bearing carrier 109 on a second side, e.g., the gearbox side. An input drive shaft 102 is attached to and extends between the hydraulic motor 101 and the gearbox 106. A sprocket shaft 103 is retained between the two opposed bearing carriers 109 and the sprocket shaft 103 is either connected to the output splines of the gearbox 106 or by a secondary shaft. In certain embodiments, the input drive shaft 102 engages a stub shaft 105 that is coupled to the gearbox 106. The input drive shaft 102 is configured to support and operate the sprocket shaft 103 and drive chains 104.

The coiled tubing injector head 100 having the improved driveline allows the motor 101, input drive shaft 102, gearbox 106, and other components on or about the injector head 100 to be replaced by the use of fastening devices 107, without having to remove the tubing or completely disassembling the injector head 100. This allows the gearbox 106 and the motor 101 because in the injector head disclosed herein, the sprocket shaft 103 and drive chains 104 are not supported by the gearbox 106. The bearing carriers 109 (these are affixed above and below the driveline as well as on both the gearbox and motor/brake side) with the spherical roller bearings 108, fully support the sprocket shaft 103, input drive shaft 102, drive chains 104, and all of the coiled tubing in the wellbore. This also allows seamless removal of the input drive shaft 102 and the stub shaft 105 for additional servicing of internal bearing seals.

The claimed subject matter is not to be limited in scope by the specific embodiments described herein. Indeed, various modifications of the invention in addition to those described herein will become apparent to those skilled in the art from the foregoing description. Such modifications are intended to fall within the scope of the appended claims.

What is claimed is:

1. A coiled tubing injector head unit comprising:

a pair of continuous parallel drive chains that revolve within a frame of the injector head unit;

a sprocket shaft that supports and rotates with the pair of continuous parallel drive chains;

a first bearing carrier attached to the frame and that supports a first end of the sprocket shaft;

a second bearing carrier attached to the frame and that supports a second end of the sprocket shaft;

a motor attached to the frame opposite the first bearing carrier;

a gearbox attached to the frame opposite the second bearing carrier;

a drive shaft that extends through the sprocket shaft and is operatively connected between the motor and the gearbox.

2. The injector head unit of claim 1, further comprising a stub shaft coupling the shaft and the gearbox.

3. The injector head unit of claim 1, wherein the first and second bearing carrier units comprise spherical roller bearings disposed within.

4. The injector head unit of claim 1, wherein the first and second bearing carrier units are conical.

5. The injector head unit of claim 1, wherein the first and second bearing carriers support the drive shaft, the sprocket shaft, and the drive chains.

* * * * *